US006962176B1

(12) United States Patent
Veira

(10) Patent No.: US 6,962,176 B1
(45) Date of Patent: Nov. 8, 2005

(54) PORTABLE SUCTION SYSTEM

(76) Inventor: Neil A Veira, 10824 61 Ave. North, Seminole, FL (US) 33772

( * ) Notice: Subject to any disclaimer, the term of this patent is extended or adjusted under 35 U.S.C. 154(b) by 566 days.

(21) Appl. No.: 10/234,915

(22) Filed: Sep. 4, 2002

(51) Int. Cl.[7] ..... B65B 31/04
(52) U.S. Cl. ..... 141/65; 141/61; 137/637.1
(58) Field of Search ..... 141/7, 8, 59, 61, 141/65; 137/205, 636, 637.1; 251/77

(56) References Cited

U.S. PATENT DOCUMENTS 4,092,993 A * 6/1978 Stevenson ..... 137/15.01
4,911,211 A * 3/1990 Andersen ..... 141/7
5,772,402 A * 6/1998 Goodman ..... 417/118
6,145,622 A * 11/2000 Clark, II ..... 184/1.5

* cited by examiner

*Primary Examiner*—Steven O. Douglas
*Assistant Examiner*—Peter deVore
(74) *Attorney, Agent, or Firm*—Edward P. Dutkiewicz

(57) ABSTRACT

A portable suction system comprises a vacuum valve subassembly. The subassembly has a body, upper and lower ball valves, and an actuating linkage. The body has a mounting portion for a tank and a valve housing portion. The mounting portion has a threaded diameter. The tank mounting portion has venturi and feed passageways. The valve housing portions have a cylindrical configurations. The body has a venturi blow-through line passageway intersecting. The ball valves are located within the passageways of the valve body. The ball valves are coupled to the actuating linkage with a trigger which rotates the ball valves into one of the positions from the category. The category includes the venturi ball valve open and feed ball valve open, and neither ball valve open. The linkage is coupled to and held in position on the outside surface of the valve body.

5 Claims, 3 Drawing Sheets

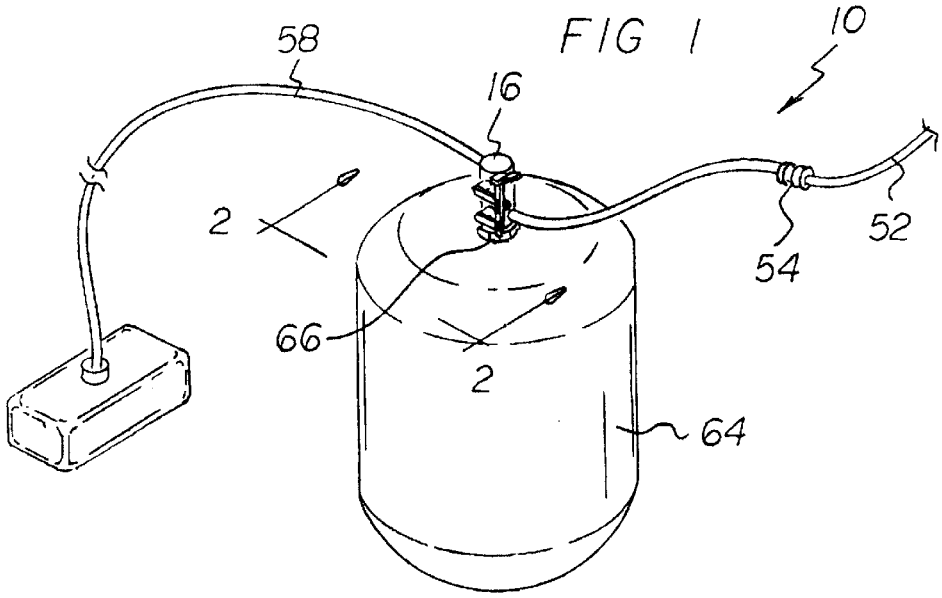
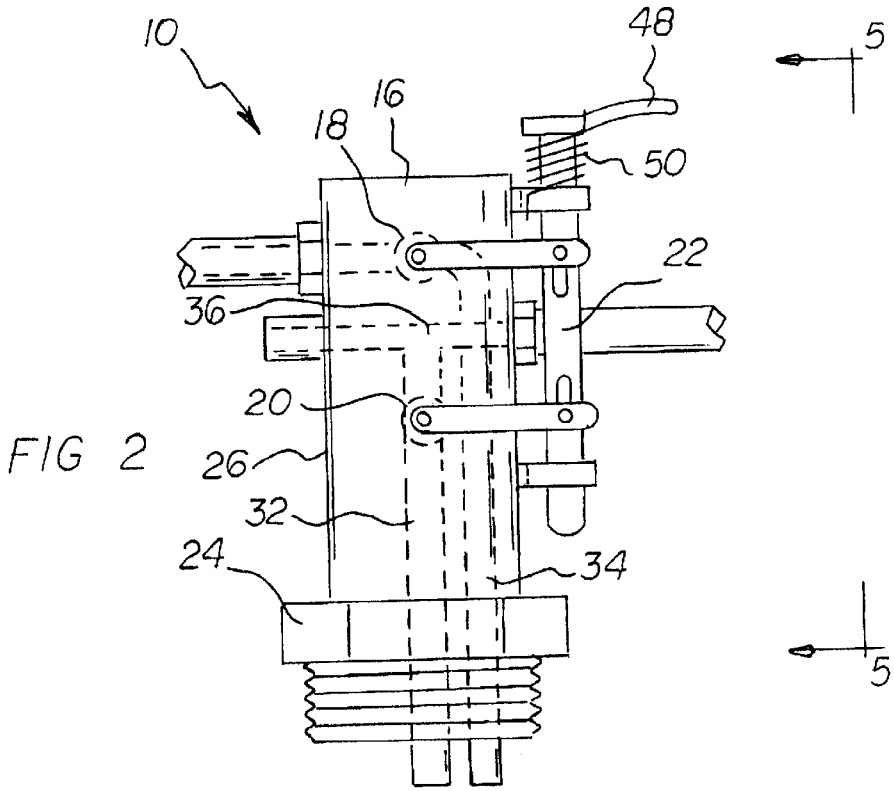
FIG 2

PORTABLE SUCTION SYSTEM

BACKGROUND OF THE INVENTION

1. Field of the Invention

The present invention relates to a portable suction system and more particularly pertains to allowing a user to safely and efficiently create negative pressure within a container.

2. Description of the Prior Art

The use of suction systems of known designs and configurations is known in the prior art. More specifically, suction systems of known designs and configurations previously devised and utilized for the purpose of creating a negative pressure through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,07,803 to DiVito et al discloses an air operated vacuum pump. U.S. Pat. No. 6,145,622 to Clark II discloses a fluid change system. U.S. Pat. No. 5,772,402 to Goodman discloses a pre-charged vacuum fluid change/disposal apparatus. U.S. Pat. No. 5,405,247 to Goodman discloses a pre-charged vacuum fluid charge-disposal apparatus. U.S. Pat. No. 4,073,602 to Cagle discloses a vacuum producing device. Finally, U.S. Pat. No. 3,716,307 to Hansen discloses a venturi head for vacuum systems.

While these devices fulfill their respective, particular objectives and requirements, the aforementioned patents do not describe a portable suction system that allows allowing a user to safely and efficiently create negative pressure within a container.

In this respect, the portable suction system according to the present invention substantially departs from the conventional concepts and designs of the prior art, and in doing so provides an apparatus primarily developed for the purpose of allowing a user to safely and efficiently create negative pressure within a container.

Therefore, it can be appreciated that there exists a continuing need for a new and improved portable suction system which can be used for allowing a user to safely and efficiently create negative pressure within a container. In this regard, the present invention substantially fulfills this need.

SUMMARY OF THE INVENTION

In view of the foregoing disadvantages inherent in the known types of suction systems of known designs and configurations now present in the prior art, the present invention provides an improved portable suction system. As such, the general purpose of the present invention, which will be described subsequently in greater detail, is to provide a new and improved portable suction system and method which has all the advantages of the prior art and none of the disadvantages.

To attain this, the present invention essentially comprises a vacuum valve subassembly. The vacuum valve subassembly is fabricated of a rigid metallic material. The subassembly has a body and an upper ball valve and a lower ball valve and an actuating linkage. The body has a lower mounting portion for a tank. The body has an upper valve housing portion. The tank mounting portion has a generally round solid cylindrical configuration. The body has a threaded lower diameter and a plurality of flat faces. In this manner the firm gripping of the tank mounting portion with a wrench is enabled by the user to turn the threads of the valve with a moderate force. The tank mounting portion has a venturi passageway and a feed passageway through the lower portion in an upward direction near the center of the threaded lower diameter. The valve housing portion has a generally rounded solid cylindrical configuration. The venturi passageway and the feed passageway continue upward between about 50 percent and 75 percent of the length of the upper valve housing portion. The feed passageway extends more upwardly than the venturi passageway. The body has a venturi blow-through line passageway intersecting with the venturi passageway in a perpendicular orientation to the passageway. The blow-through passageway has a pressurized end and an exhaust end. The pressurized end has a threaded internal diameter. The exhaust end has a nipple. The nipple projects from the outside diameter of the valve body. The feed passageway runs upward and then turns to run parallel with the venturi passageway. The feed line exits the valve body. A threaded aperture is provided at the exit location of the feed passageway. The ball valves are located within the passageways of the valve body. The ball valves are coupled to the actuating linkage with an operator controlled trigger and with an associated coil spring. The coil spring rotates the ball valves into one of the positions from the category. The category includes only the venturi ball valve open and only the feed ball valve open; and neither ball valve open. The linkage is coupled to and firmly held in position on the outside surface of the valve body. Provided next is a pressurized gas source. The gas source has a coupling line. The coupling line mates with and couples to the threaded internal diameter of the blow-through passageway of the valve body. Further provided is a suction line. The suction line has a semi-rigid hollow cylindrically tubular configuration. The suction line has a threaded end portion. :The end portion is sized to be received into and securely held by and coupled to the threaded aperture of the feed passageway of the valve body. Provided last is a hollow container. The hollow container is fabricated of a rigid metallic material. The container has a threaded opening into the container. The threaded opening is sized to receive and firmly hold the threaded lower portion of the valve body.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable suction system which has all of the advantages of the prior art suction systems of known designs and configurations and none of the disadvantages.

It is another object of the present invention to provide a new and improved portable suction system which may be easily and efficiently manufactured and marketed.

It is further an object of the present invention to provide a new and improved portable suction system which is of durable and reliable constructions.

An even further object of the present invention is to provide a new and improved portable suction system which is susceptible of a low cost of manufacture with regard to both materials and labor, and which accordingly is then susceptible of low prices of sale to the consuming public, thereby making such portable suction system economically available to the buying public.

Even still another object of the present invention is to provide a portable suction system for allowing a user to safely and efficiently create negative pressure within a container.

An important object is also the providing of a use for spent propane tanks or cylinders, normally discarded after use with a barbecue grill.

Lastly, it is an object of the present invention to provide a new and improved portable suction system comprising a vacuum valve subassembly. The subassembly has a body, upper and lower ball valves, and an actuating linkage. The body has a mounting portion for a tank and a valve housing portion. The mounting portion has a threaded diameter. The tank mounting portion has venturi and feed passageways. The valve housing portions have a cylindrical configurations. The body has a venturi blow-through line passageway intersecting. The ball valves are located within the passageways of the valve body. The ball valves are coupled to the actuating linkage with a trigger which rotates the ball valves into one of the positions from the category. The category includes the venturi ball valve open and feed ball valve open, and neither ball valve open. The linkage is coupled to and held in position on the outside surface of the valve body.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the portable suction system constructed in accordance with the principles of the present invention.

FIG. 2 is a side elevational view of the vacuum valve assembly taken along line 2—2 with the vacuum valve in the usual position.

The same reference numerals refer to the same parts throughout the various Figures.

DESCRIPTION OF THE PREFERRED EMBODIMENT

Figure 3:
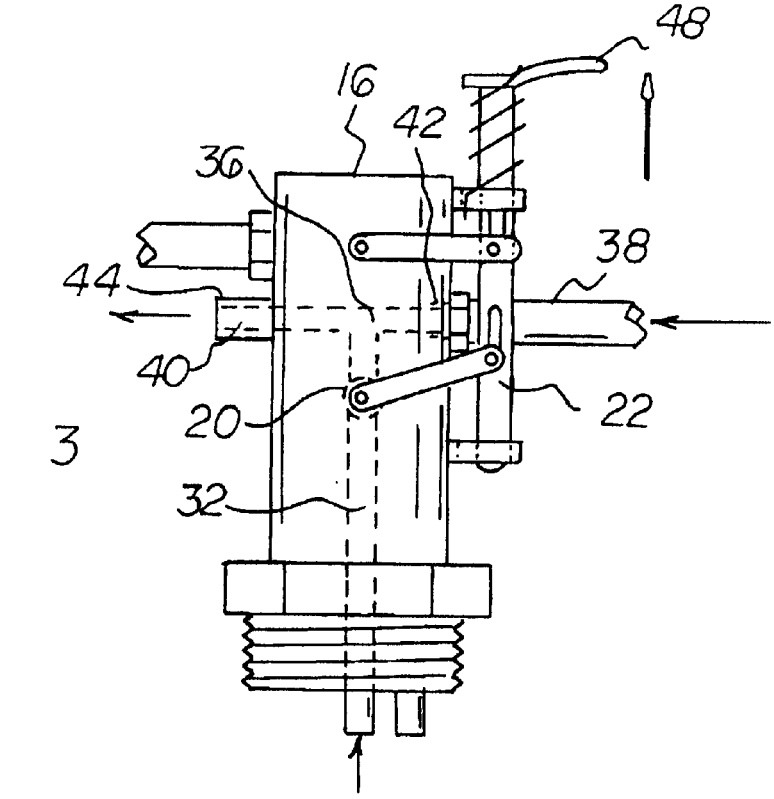
FIG. 3 is a side elevational view similar to FIG. 2 but illustrating the lift lever and linkage in a raised position for causing a venturi effect and vacuum in a container there below.
Figure 4:
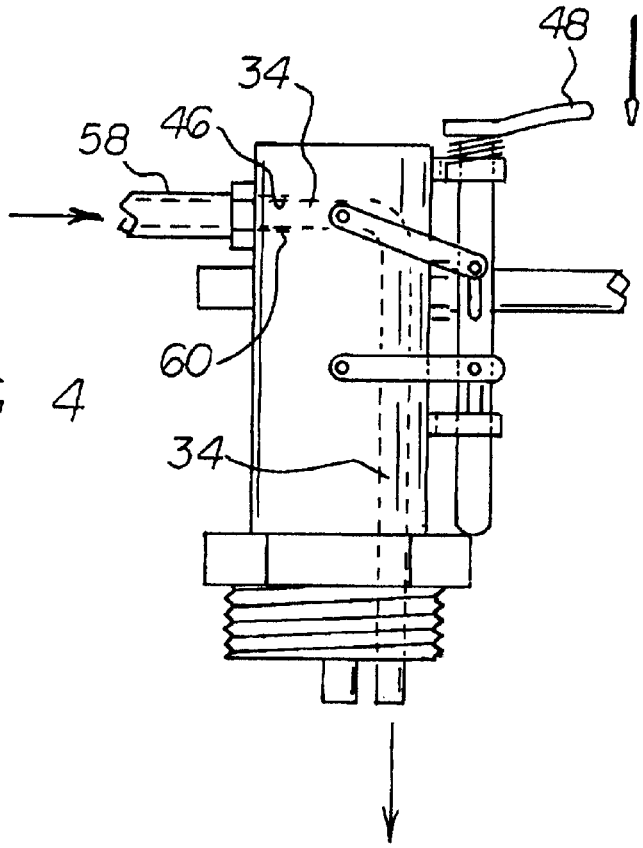
FIG. 4 is a side elevational view similar to FIGS. 2 and 3 but illustrating the lift lever and actuating linkage in a depressed orientation to effect suction from the liquid chamber.
Figure 5:
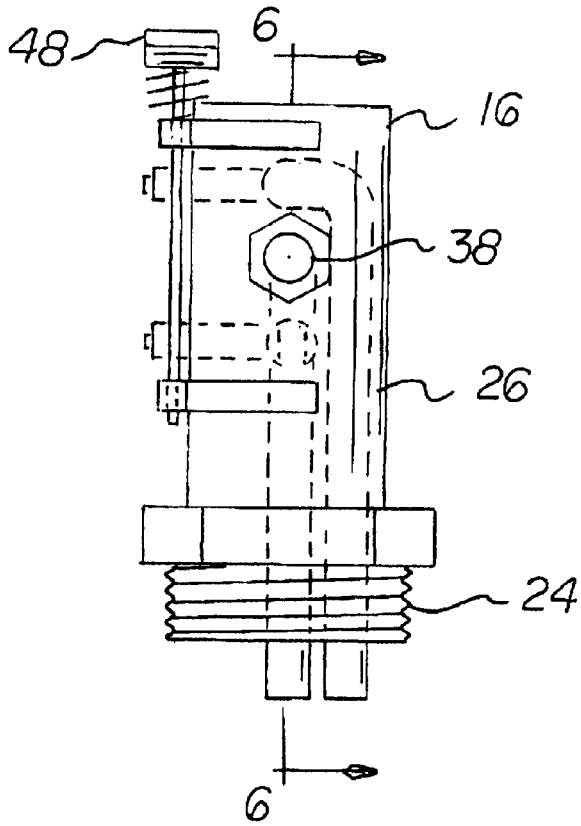
FIG. 5 is a front elevational view of the vacuum valve assembly taken along line 5—5 of FIG. 2.
Figure 6:
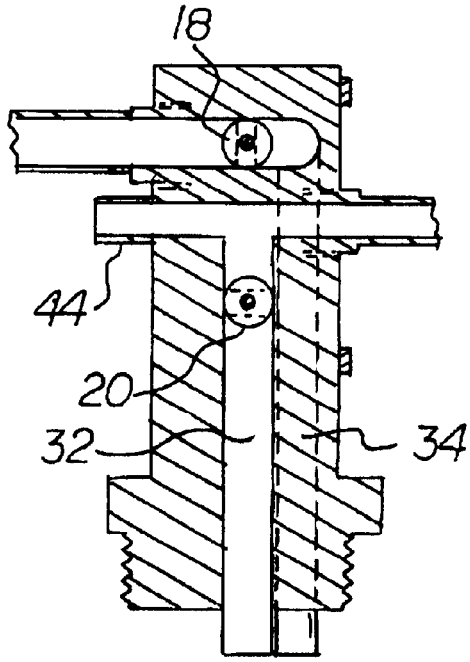
FIG. 6 is a cross sectional view taken along line 6—6 of FIG. 5.

With reference now to the drawings, and in particular to FIG. 1 thereof, the preferred embodiment of the new and improved portable suction system embodying the principles and concepts of the present invention and generally designated by the reference numeral 10 will be described.

First provided is a vacuum valve subassembly. The vacuum valve subassembly is fabricated of a rigid metallic material. The subassembly has a body 16 and an upper ball valve 18 and a lower ball valve 20 and an actuating linkage 22. The body has a lower mounting portion 24 for a tank. The body has an upper valve housing portion 26. The tank mounting portion has a generally round solid cylindrical configuration. The body has a threaded lower diameter and a plurality of flat faces. In this manner the firm gripping of the tank mounting portion with a wrench is enabled by the user to turn the threads of the valve with a moderate force. The tank mounting portion has a venturi passageway 32 and a feed passageway 34 through the lower portion in an upward direction near the center of the threaded lower diameter. The valve housing portion has a generally rounded solid cylindrical configuration. The venturi passageway and the feed passageway continue upward between about 50 percent and 75 percent of the length of the upper valve housing portion. The feed passageway extends more upwardly than the venturi passageway. The body has a venturi blow-through line passageway 36 intersecting with the venturi passageway in a perpendicular orientation to the passageway. The blow-through passageway has a pressurized end 38 and an exhaust end 40. The pressurized end has a threaded internal diameter 42. The exhaust end has a nipple 44. The nipple projects from the outside diameter of the valve body. The feed passageway runs upward and then turns to run parallel with the venturi passageway. The feed line exits the valve body. A threaded aperture 46 is provided at the exit location of the feed passageway. The ball valves are located within the passageways of the valve body. The ball valves are coupled to the actuating linkage with an operator controlled trigger 48 and with an associated coil spring 50. The coil spring rotates the ball valves into one of the positions from the category. The category includes only the venturi ball valve open and only the feed ball valve open, and neither ball valve open. The linkage is coupled to and firmly held in position on the outside surface of the valve body.

Provided next is a pressurized gas source 52. The gas source has a coupling line 54. The coupling line mates with and couples to the threaded internal diameter of the blow-through passageway of the valve body.

Further provided is a suction line 58. The suction line has a semi-rigid hollow cylindrically tubular configuration. The suction line has a threaded end portion 60. The end portion is sized to be received into and securely held by and coupled to the threaded aperture of the feed passageway of the valve body.

Provided last is a hollow container 64. The hollow container is fabricated of a rigid metallic material. The container has a threaded opening 66 into the container. The threaded opening is sized to receive and firmly hold the threaded lower portion of the valve body.

The valve and Venturi arrangement is assembled on a threaded plumbing plug and is adapted to replace the existing valve on a standard propane cylinder tank, normally 20 pound tanks used on barbecue grills. In the past, such propane cylinders or tanks were discarded thereby causing problems. The present invention converts a problem into a beneficial solution by creating a valuable use for such cylinders or tanks.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable suction system for allowing a user to safely and efficiently create a negative pressure within a container comprising, in combination:

a vacuum valve subassembly fabricated of a rigid metallic material and having a body and an upper ball valve and a lower ball valve and an actuating linkage, the body having a lower mounting portion a for a tank and an upper valve housing portion with the tank mounting portion having a generally round solid cylindrical configuration with a threaded lower diameter and a plurality of flat faces for allowing the firm gripping of the tank mounting portion with a wrench to enable the user to turn the threads of the valve with a moderate force, with the tank mounting portion having a venturi passageway and a feed passageway through the lower portion in an upward direction near the center of the threaded lower diameter, with the valve housing portion having a generally rounded solid cylindrical configuration with the venturi passageway and the feed passageway from the tank mounting portion continuing upward between about 50 percent and 75 percent of the length of the upper valve housing portion, with the feed passageway extending more upwardly than the venturi passageway, the body having a venturi blow-through line passageway intersecting with the venturi passageway in a perpendicular orientation to the passageway with the blow-through passageway having a pressurized end and an exhaust end, with the pressurized end having a threaded internal diameter and the exhaust end having a nipple projecting from the outside diameter of the valve body, with the feed passageway running upward and then turning to run parallel with the venturi passageway with the feed line exiting the valve body and having at the exit location of the feed passageway a threaded aperture, with the ball valves being located within the passageways of the valve body, the ball valves being coupled to the actuating linkage with an operator controlled trigger and with an associated coil spring which rotates the ball valves into one of the positions from the category which includes only the venturi ball valve open, and only the feed ball valve open, and neither ball valve open, with the linkage being coupled to and firmly held in position on the outside surface of the valve body;

a pressurized gas source having a coupling line mating with and coupling to the threaded internal diameter of the blowthrough passageway of the valve body;

a suction line having a semi-rigid hollow cylindrically tubular configuration with a threaded end portion sized to be received into and securely held by and coupled to the threaded aperture of the feed passageway of the valve body; and a hollow container fabricated of a rigid metallic material having a threaded opening 66 into the container sized to receive and firmly hold the threaded lower portion of the valve body.

2. A portable suction system comprising:

a vacuum valve subassembly having a body and an upper ball valve and a lower ball valve and an actuating linkage, the body having a lower mounting portion for a tank and an upper valve housing portion with the tank mounting portion having a threaded lower diameter, with the tank mounting portion having a venturi passageway and a feed passageway through the lower portion in an upward direction near the center of the threaded lower diameter, with the valve housing portion having a generally rounded solid cylindrical configuration with the venturi passageway and the feed passageway from the tank mounting portion, the body having a venturi blow-through line passageway intersecting with the venturi passageway in a perpendicular orientation to the passageway with the blow-through passageway having a pressurized end and an exhaust end, with the ball valves being located within the passageways of the valve body with the ball valves being coupled to the actuating linkage with a trigger which rotates the ball valves into one of the positions from the category which includes the venturi ball valve open and feed ball valve open, and neither ball valve open, with the linkage being coupled to and firmly held in position on the outside surface of the valve body.

3. The system as set forth in claim 2 and further including a pressurized gas source having a coupling line mating with and coupling to the blow-through passageway of the valve body.

4. The system as set forth in claim 2 and further including a suction line having a semi-rigid hollow cylindrically tubular configuration with a threaded end portion sized to be received into and securely held by and coupled to the threaded aperture of the feed passageway of the valve body.

5. The system as set forth in claim 2 and further including a hollow container fabricated of a rigid metallic material having a threaded opening into the container sized to receive and firmly hold the threaded lower portion of the valve body.

* * * * *